US009445630B1

(12) United States Patent
Modi et al.

(10) Patent No.: US 9,445,630 B1
(45) Date of Patent: Sep. 20, 2016

(54) PRE-PACKED TOBACCO INSERT DEVICE

(71) Applicants: Jigar Modi, Parsippany, NJ (US); Rajat Patel, Parsippany, NJ (US)

(72) Inventors: Jigar Modi, Parsippany, NJ (US); Rajat Patel, Parsippany, NJ (US)

( * ) Notice: Subject to any disclaimer, the term of this patent is extended or adjusted under 35 U.S.C. 154(b) by 384 days.

(21) Appl. No.: 14/062,331

(22) Filed: Oct. 24, 2013

(51) Int. Cl.
*A24F 5/00* (2006.01)
*A24F 9/04* (2006.01)

(52) U.S. Cl.
CPC ..... *A24F 9/04* (2013.01)

(58) Field of Classification Search
CPC ..... A24F 1/30; A24F 5/00; A24F 5/02; A24F 5/04
See application file for complete search history.

(56) References Cited

U.S. PATENT DOCUMENTS

| | | | | |
|---|---|---|---|---|
| 647,740 | A | 4/1900 | Beatty | |
| 4,161,954 | A | 7/1979 | Fornaciari | |
| D618,389 | S * | 6/2010 | Masri | D27/162 |
| D632,426 | S | 2/2011 | Badawi | |
| 8,347,892 | B2 | 1/2013 | Mehio | |
| 2008/0060663 | A1* | 3/2008 | Hamade | A24B 13/00 131/178 |
| 2010/0083973 | A1* | 4/2010 | Zoumut | A24F 1/30 131/173 |
| 2010/0126518 | A1 | 5/2010 | Saleh | |
| 2010/0242973 | A1* | 9/2010 | Mehio | A24F 1/30 131/173 |
| 2011/0088706 | A1 | 4/2011 | Badawi | |
| 2013/0167852 | A1* | 7/2013 | McDonald | A24F 1/00 131/328 |
| 2015/0075544 | A1* | 3/2015 | Portz | A24D 1/14 131/328 |

* cited by examiner

*Primary Examiner* — Michael H Wilson
*Assistant Examiner* — Eric Yaary

(57) ABSTRACT

A pre-packed tobacco insert device facilitates packing and clean up of tobacco smoked using a hookah. The device includes a bowl having a bottom surface and a perimeter wall coupled to and extending upwardly from the bottom surface defining an interior space. A plurality of apertures extends through the bottom surface of the bowl and pre-packed tobacco is positioned within the interior space. A conduit has an upper end in fluid communication with the interior space of the bowl and an open lower end configured for coupling to the input pipe of a hookah. A cover is coupled to an upper edge of the perimeter wall of the bowl. A plurality of holes extends through the cover wherein the cover is configured for providing ambient air flow into the interior space of the bowl when a user inhales through the hookah.

10 Claims, 5 Drawing Sheets

PRE-PACKED TOBACCO INSERT DEVICE

BACKGROUND OF THE DISCLOSURE

Field of the Disclosure

The disclosure relates to tobacco packaging devices and more particularly pertains to a new tobacco packaging device for facilitating packing and clean up of tobacco smoked using a hookah.

SUMMARY OF THE DISCLOSURE

An embodiment of the disclosure meets the needs presented above by generally comprising a bowl having a bottom surface and a perimeter wall coupled to and extending upwardly from the bottom surface defining an interior space. A plurality of apertures extends through the bottom surface of the bowl and pre-packed tobacco is positioned within the interior space. A conduit has an upper end in fluid communication with the interior space of the bowl and an open lower end configured for coupling to the input pipe of a hookah. A cover is coupled to an upper edge of the perimeter wall of the bowl. A plurality of holes extends through the cover wherein the cover is configured for providing ambient air flow into the interior space of the bowl when a user inhales through the hookah.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
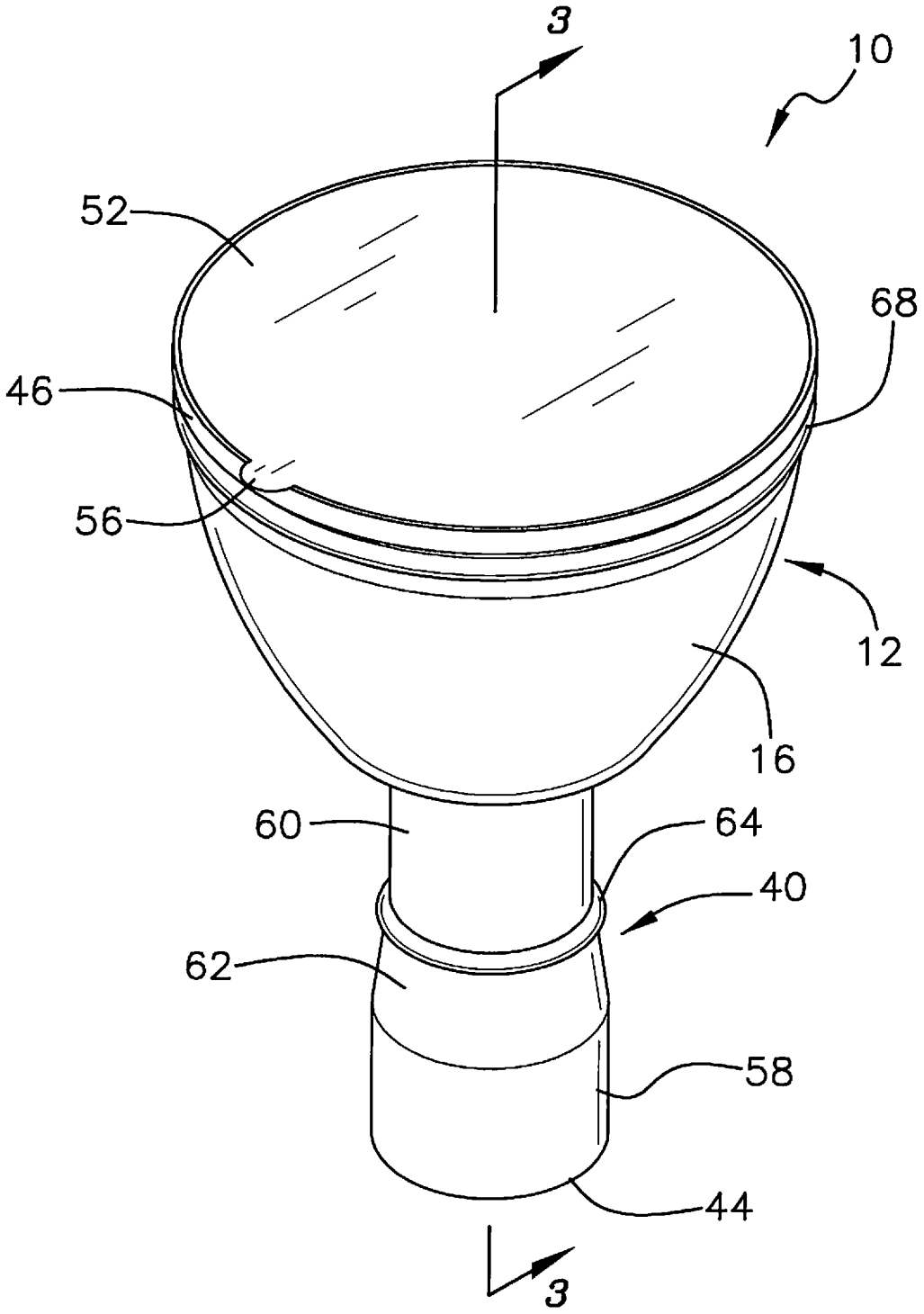
FIG. 1 is a top front side perspective view of a pre-packed tobacco insert device according to an embodiment of the disclosure.
Figure 2:
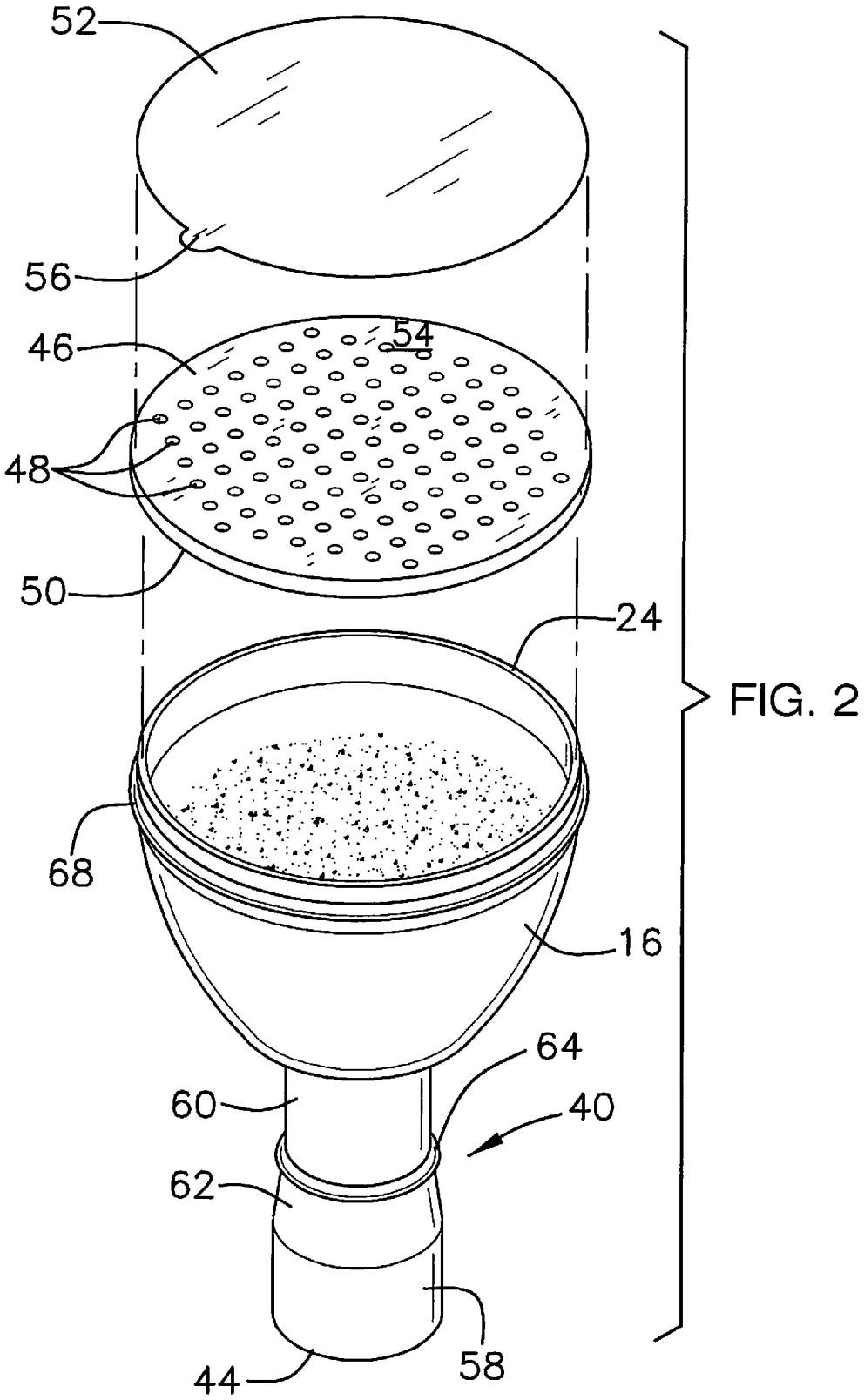
FIG. 2 is an exploded top front side perspective view of an embodiment of the disclosure.
Figure 3:
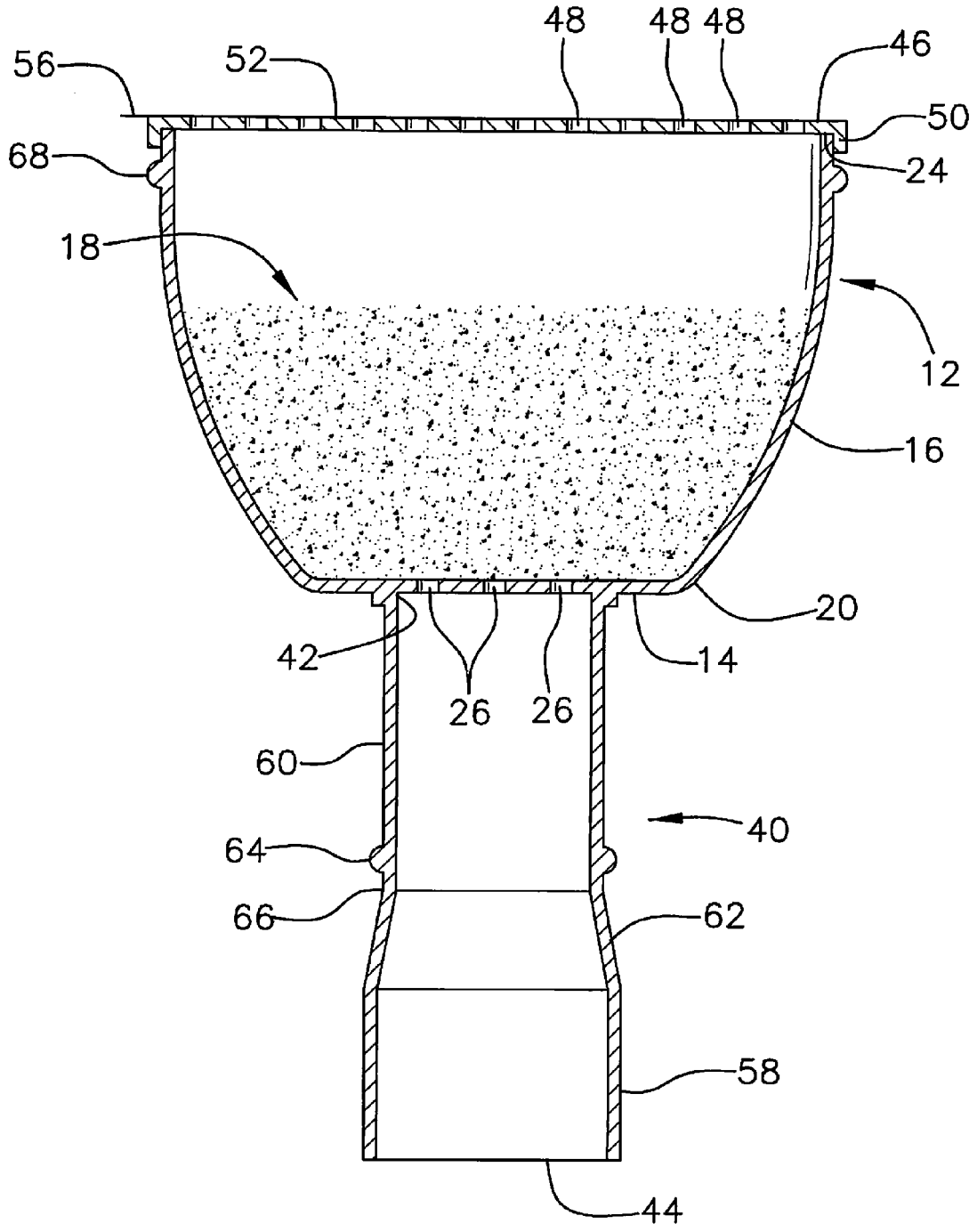
FIG. 3 is a cross-sectional view of an embodiment of the disclosure taken along line 3-3 of FIG. 1.
Figure 4:
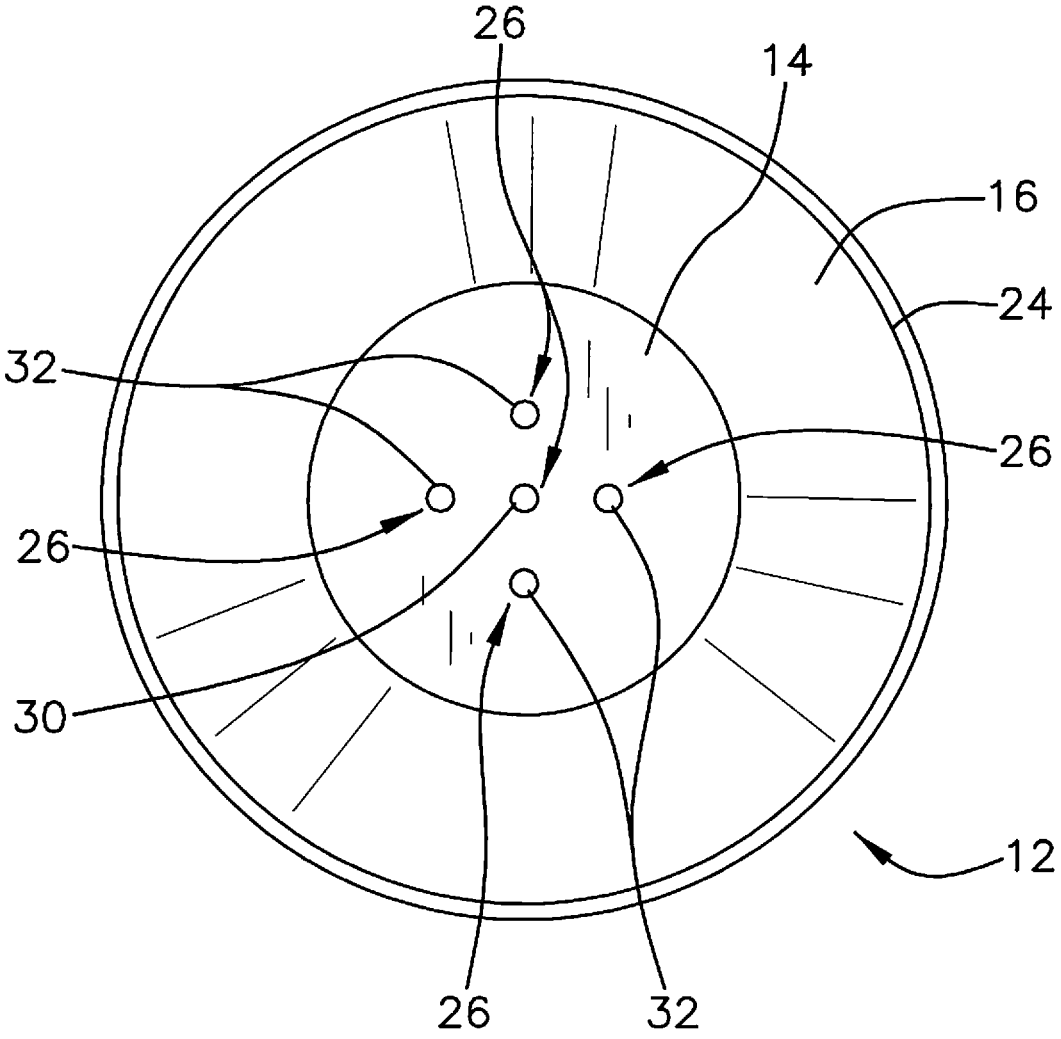
FIG. 4 is a top view of an embodiment of the disclosure.

With reference now to the drawings, and in particular to FIGS. 1 through 5 thereof, a new tobacco packaging device embodying the principles and concepts of an embodiment of the disclosure and generally designated by the reference numeral 10 will be described.

As best illustrated in FIGS. 1 through 5, the pre-packed tobacco insert device 10 generally comprises a bowl 12 having a bottom surface 14 and a perimeter wall 16 coupled to and extending upwardly from the bottom surface 14 defining an interior space 18. The perimeter wall 16 of the bowl 12 is parabolic extending outwardly and upwardly from an outer perimeter edge 20 of the bottom surface 14 towards an upper edge 24 of the perimeter wall 16. A plurality of apertures 26 extending through the bottom surface 14 of the bowl 12. The apertures 26 may include a central aperture 30 and a plurality of outer apertures 32 radially positioned with respect to the central aperture 30. Tobacco 34 is pre-packed and positioned within the interior space 20 to provide a consistent desired amount of tobacco 34 within the bowl 12. The amount and type of tobacco 34 may be varied and labeled to facilitate selection and use of a desired preference but may be consistent with the labeling to insure the desired result from use of the device 10.

A conduit 40 has an upper end 42 coupled to the bowl 12, more specifically to the bottom wall 14, such that the upper end 42 of the conduit 40 is in fluid communication with the interior space 20 of the bowl 12 through the apertures 26. The conduit 40 has a lower end 44 configured for coupling to an input pipe or stem of a hookah. The lower end 44 of the conduit 40 is open wherein the lower end 44 is configured for receiving the input pipe of the hookah.

A cover 46 is coupled to the upper edge 24 of the perimeter wall 16 of the bowl 12. A plurality of holes 48 extends through the cover 46. An outer edge 50 of the cover 46 is sealed to the bowl 12 wherein the cover 46 is configured for providing ambient air flow into the interior space 20 of the bowl 12 through the holes 48 when a user inhales through the hookah. A planar sheet 52 is coupled to and extends over an upper surface 54 of the cover 46. The sheet 52 covers the holes 48 extending through the cover 46. The sheet 52 is selectively removable to provide air flow into the interior space 20 of the bowl 12 through the cover 46 during use of the hookah. A tab 56 is coupled to and extends from the sheet 52. The tab 56 extends outwardly from the cover 46 wherein the tab 56 is configured for being grasped to facilitate removal of the sheet 52 from the cover 46.

A lower section 58 of the conduit 40 may have a greater diameter than an upper section 60 of the conduit 40. A medial section 62 of the conduit 40 may be angled with respect to a longitudinal axis of the conduit 40 such that the medial section 62 extends outwardly from the upper section 60 of the conduit 40 to the lower section 58 of the conduit 40. An annular lower lip 64 may extend outwardly from the conduit 40 proximate a junction 66 of the upper section 60 of the conduit 40 and the medial section 62 of the conduit 40. An annular upper lip 68 may extend outwardly from the perimeter wall 16 proximate the upper edge 24 of the perimeter wall 16 to facilitate grasping and lifting of the bowl 12.

Figure 5:
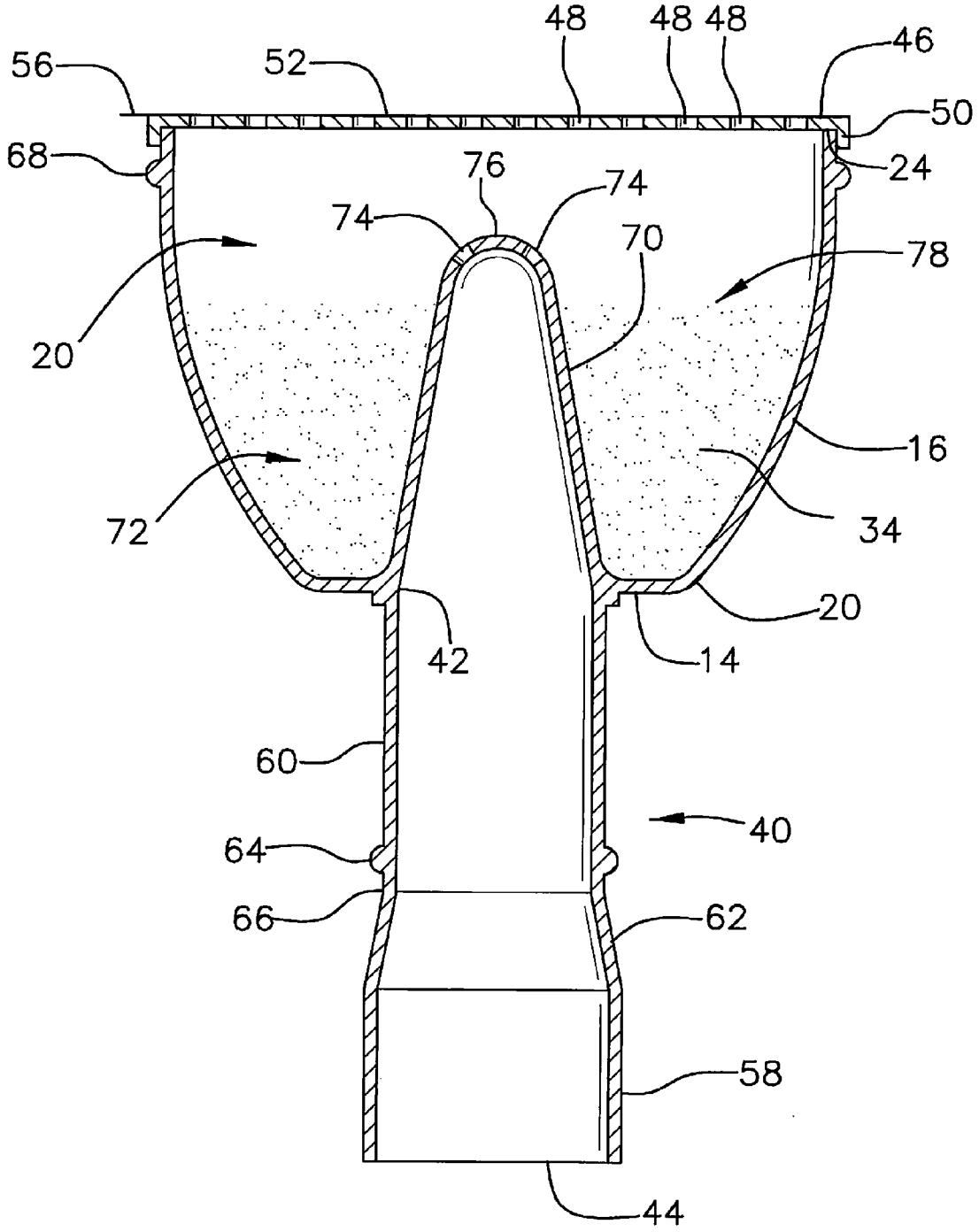
FIG. 5 is a cross-sectional view of an alternative embodiment of the disclosure similar to FIG. 3.

The bottom surface 14 of the bowl 12 may be planar or flat as shown in FIGS. 1 through 4. The bottom surface 14 of the bowl 12 is substantially transverse with respect to a longitudinal axis of the conduit 40. Alternatively, as shown in FIG. 5, the bottom wall 14 of the bowl 12 may include a tubular center portion 70 extending upwardly within the bowl 12 wherein a bottom portion 72 of the interior space 20 is ring-shaped extending around the center portion 70 of the bottom wall 14. The center portion 70 may be conical. The center portion 70 permits the positioning of apertures 74 proximate an apex 76 of the center portion 70 such that each aperture 74 is positioned in spaced relationship above an upper surface 78 of the tobacco 34 positioned in the interior space 20. In other respects, unless mutually exclusive, variations of the described embodiments may be combined or interchanged.

The bowl 12, cover 46, and conduit 40 may each be constructed of aluminum or the like. The sheet 52 is removed prior to use and may be constructed of either foil, plastic, rubber, or the like.

In use, the lower section 58 of the conduit 40 is positioned over the input pipe or stem of the hookah. The sheet 52 is removed from the cover 46 and the hookah is ready for use in a conventional manner. When the tobacco 34 is expended, the device 10 is removed and may be replaced by another for continued use of the hookah.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

We claim:

1. A pre-packed tobacco insert device for use in a hookah having an input pipe, the device comprising:

a bowl having a bottom surface and a perimeter wall coupled to and extending upwardly from said bottom surface defining an interior space;

a plurality of apertures extending through said bottom surface of said bowl;

tobacco positioned within said interior space;

a conduit having an upper end coupled to said bowl such that said upper end of said conduit is in fluid communication with said interior space of said bowl, said conduit having a lower end configured for coupling to the input pipe of the hookah, said lower end of said conduit being open wherein said lower end is configured for receiving the input pipe of the hookah;

a cover coupled to an upper edge of said perimeter wall of said bowl;

a plurality of holes extending through said cover wherein said cover is configured for providing ambient air flow into said interior space of said bowl when a user inhales through the hookah; and said bottom wall of said bowl having a tubular center portion extending upwardly within said bowl wherein a bottom portion of said interior space is ring-shaped extending around said center portion of said bottom wall, said apertures being positioned facing outwardly and upwardly proximate an apex of said center portion such that each said aperture is positioned in spaced relationship above an upper surface of said tobacco positioned in said interior space.

2. The device of claim 1, further comprising a sheet coupled to and extending over an upper surface of said cover, said sheet covering said holes extending through said cover, said sheet being selectively removable to provide air flow into said interior space of said bowl through said cover.

3. The device of claim 2, further comprising a tab coupled to and extending from said sheet, said tab extending outwardly from said cover wherein said tab is configured for being grasped to facilitate removal of said sheet from said cover.

4. The device of claim 1, further comprising said perimeter wall of said bowl being parabolic extending outwardly and upwardly from said bottom surface towards said upper edge of said perimeter wall.

5. The device of claim 1, further comprising said apertures including a central aperture and a plurality of outer apertures radially positioned with respect to said central aperture.

6. The device of claim 1, further comprising said bottom surface of said bowl being flat.

7. The device of claim 6, further comprising said bottom surface of said bowl being transverse with respect to a longitudinal axis of said conduit.

8. The device of claim 1, further comprising a lower section of said conduit having a greater diameter than an upper section of said conduit.

9. The device of claim 8, further comprising a medial section of said conduit being angled with respect to a longitudinal axis of said conduit such that said medial section extends outwardly from said upper section of said conduit to said lower section of said conduit.

10. The device of claim 9, further comprising an annular lower lip extending outwardly from said conduit proximate a junction of said upper section of said conduit and said medial section of said conduit.

* * * * *